US007137905B2

(12) United States Patent
Kohno

(10) Patent No.: US 7,137,905 B2
(45) Date of Patent: Nov. 21, 2006

(54) GOLF CLUB HEAD

(75) Inventor: Masaru Kohno, Kobe (JP)

(73) Assignee: SRI Sports Limited, Kobe (JP)

( * ) Notice: Subject to any disclaimer, the term of this patent is extended or adjusted under 35 U.S.C. 154(b) by 0 days.

(21) Appl. No.: 10/725,458

(22) Filed: Dec. 3, 2003

(65) Prior Publication Data

US 2004/0157678 A1 Aug. 12, 2004

(30) Foreign Application Priority Data

Dec. 19, 2002 (JP) ..... 2002-368565

(51) Int. Cl.
*A63B 53/04* (2006.01)

(52) U.S. Cl. ..... 473/314; 473/338; 473/345; 473/349

(58) Field of Classification Search ..... 473/314, 473/345, 349, 338, 312
See application file for complete search history.

(56) References Cited

U.S. PATENT DOCUMENTS 5,935,020 A * 8/1999 Stites et al. ..... 473/345
6,354,962 B1 * 3/2002 Galloway et al. ..... 473/342
6,379,265 B1 * 4/2002 Hirakawa et al. ..... 473/338
6,821,214 B1 * 11/2004 Rice ..... 473/345

FOREIGN PATENT DOCUMENTS

JP 1-166781 * 6/1989
JP 11-33145 A 2/1999
JP 2000-210398 * 8/2000
JP 2001-299968 A 10/2001

* cited by examiner

*Primary Examiner*—Stephen Blau
(74) *Attorney, Agent, or Firm*—Birch, Stewart, Kolasch & Birch, LLP

(57) ABSTRACT

The present invention provides a golf club head which satisfies the following three conditions in a moment M of inertia around a center line of a shaft axis (g·cm$^2$) and a depth L of center of gravity (mm):

$$4000 \leqq M \leqq 7000; \quad (1)$$

$$30 \leqq L \leqq 50; \text{ and} \quad (2)$$

$$M \leqq 200 \times L - 2000. \quad (3)$$

14 Claims, 9 Drawing Sheets

CROSS SECTION TAKEN ALONG LINE B-B

CROSS SECTION TAKEN ALONG LINE B-B

CROSS SECTION TAKEN ALONG LINE C-C

CROSS SECTION TAKEN ALONG LINE D-D

CROSS SECTION TAKEN ALONG LINE E-E

GOLF CLUB HEAD

This Nonprovisional application claims priority under 35 U.S.C. § 119(a) on Patent Application No(s). 2002-368565 filed in JAPAN on Dec. 19, 2002, the entire contents of which are hereby incorporated by reference.

BACKGROUND OF THE INVENTION

1. Field of the Invention

The present invention relates to a golf club head which is excellent in directionality of a hit ball.

2. Description of the Related Art

In accordance with an increase of a head volume in recent years, a moment of inertia around a center line of a shaft axis is increased in a golf club. The moment of inertia around the center line of the shaft axis has a close relation to a return of the head during a swing. For example, Japanese Unexamined Patent Publication No. 2001-299968 teaches that when the moment of inertia around the center line of the shaft axis becomes great, it becomes easy to hit the ball in a state where a face is open at a time of swinging. As a result, a miss shot called a "slice" tends to occur.

Further, the large size of the head volume has an inclination to make a depth of center of gravity of the head large. In Japanese Unexamined Patent Publication No. 11-33145 (1999), there is suggested that the larger the depth of center of gravity of the head is, the better the directionality of the hit ball is.

Further, the large-sized head has an inclination to make a moment of inertia around a vertical axis passing through the center of gravity of the head, in addition to the moment of inertia around the center line of the shaft axis. In the swing process, if the hitting face of the head can be positioned in an address state, such a head can hit the ball with a small displacement with respect to the intended direction even when the head hits the ball by a portion of the hitting face close to a toe or a heel. Accordingly, conventionally, it is sufficient that the large-sized head has a magnitude of the depth of center of gravity which is consequently defined on the basis of the head shape, so that there is no idea for further improving the depth of center of gravity.

The present inventors have measured the depth of center of gravity of the various heads and the moment of inertia around the center line of the shaft axis. The result of measurement is shown in FIG. 5. In FIG. 5, the conventional head is plotted by black dots. It is known from this graph that the head having the great moment M of inertia around the center line of the shaft axis has a great depth L of center of gravity.

However, taking a view of swing of golfers, most of the golfers belong to the following two types:

(a) a type that a head speed is high in a swing initial stage and is low in a swing later stage; and (b) a type that a head speed is increased from a swing initial state to a swing later stage.

Further, taking a view of a certain golfer, there is a case where the type (a) and the type (b) alternately appear per swing. In particular, since a beginner golfer has no stable head speed, the beginner golfer develops a strong tendency to the above. As a result, the beginner golfer has an inclination that the direction of the hit ball is not stable. Further, the greater the moment of inertia around the center line of the shaft axis in the head is, the more the above inclination is occurred.

SUMMARY OF THE INVENTION

The present invention is made by taking the above problems into consideration, and a main object of the present invention is to provide a golf club head capable of hitting a ball in an intended direction on the basis of connecting a moment of inertia around a center line of a shaft axis with a depth of center of gravity under a fixed condition.

In accordance with the present invention, there is provided a golf club head satisfying the following three conditions in a moment M of inertia around a center line of a shaft axis ($g \cdot cm^2$) and a depth L of center of gravity (mm):

$$4000 \leqq M \leqq 7000; \quad (1)$$

$$30 \leqq L \leqq 50; \text{ and} \quad (2)$$

$$M \leqq 200 \times L - 2000. \quad (3)$$

DETAILED DESCRIPTION OF THE INVENTION

Hereinafter, description will be given of an embodiment in accordance with the present invention with reference to the accompanying drawings.

Figure 1:
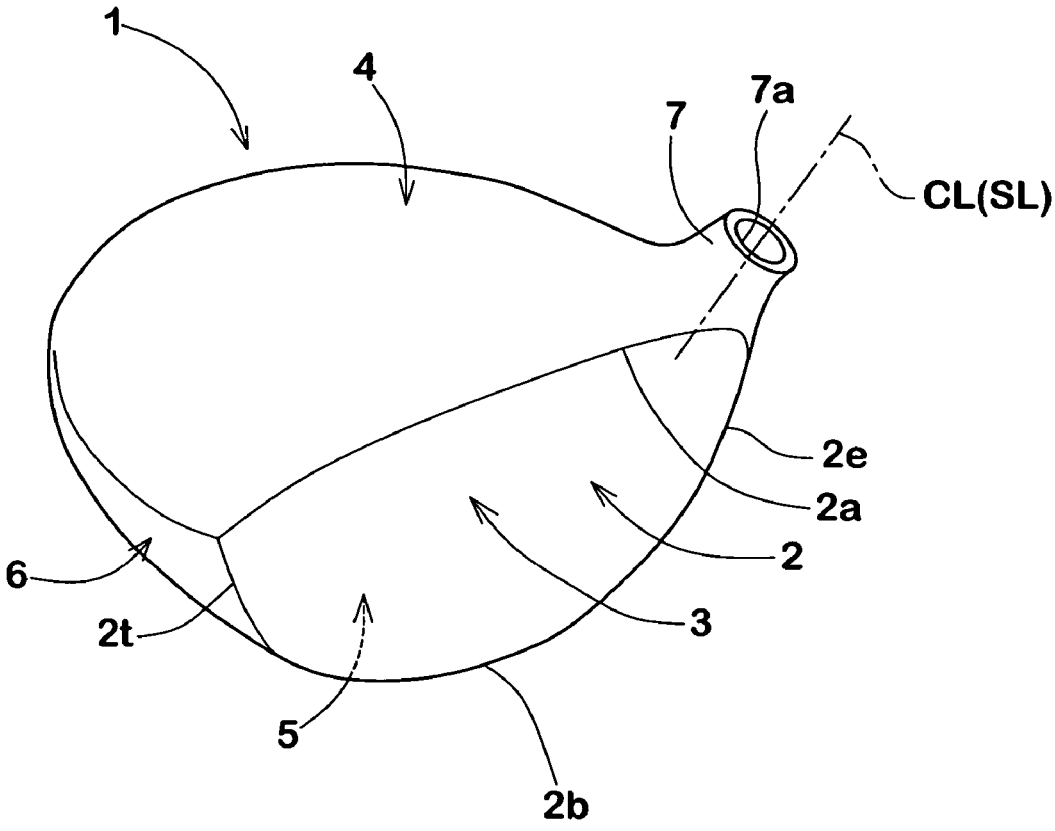
FIG. 1 is a perspective view showing a head in accordance with an embodiment of the present invention.

In FIG. 1, there is illustrated a wood type driver (#1), as a golf club head (hereinafter, simply referred as "head" in some cases) 1 in accordance with the present invention. The wood type head does not mean a head formed by a wooden material, but means a head which has been conventionally formed by the wooden material, and is a concept, specifically, including at least the driver (#1), a brassie (#2), a spoon (#3), a baffy (#4) or a cleek (#5), and further including a head having an approximately similar shape.

The head 1 is illustrated as a head constituted by a face portion 3 forming a hitting face 2 corresponding to a surface hitting a ball, a crown portion 4 extending from an upper edge 2*a* of the hitting face 2 and forming a head upper surface, a sole portion 5 extending from a lower edge 2*b* of the hitting face 2 and forming a head bottom surface (the sole portion 5 is invisible in FIG. 1), a side portion 6 extending between the crown portion 4 and the sole portion 5 from a toe side edge 2*t* of the hitting face 2 through a back face to a heel side edge 2*e* of the hitting face 2, and a neck portion 7 to which one end of a shaft (not shown) is attached.

A cylindrical shaft insertion hole 7*a* is formed in the neck portion 7. A shaft (not shown) is inserted to the shaft insertion hole 7*a*. Further, an axial center line CL of the shaft insertion hole 7*a* and a shaft axis center line (SL) substantially coincide with each other. Accordingly, in the case of aligning the head I with a lie angle or in the case of measuring a moment if inertia around the center line of the shaft axis, the "axial center line CL of the shaft insertion hole 7*a*" is utilized as the "shaft axis center line SL".

The head 1 is made, for example, of aluminum alloy, titanium, titanium alloy, stainless steel, other metal materials, or fiber reinforcing resin. Although the material is not particularly limited, it is preferable that the head 1 is made of titanium alloy having a high specific tensile strength. Further, the head 1 in accordance with the present embodiment is shown as a head in which a main portion is formed in accordance with a lost wax forging method of $\alpha+\beta$ type titanium alloy (Ti-6Al-4V), and the other part is welded to the main portion. In this case, the manufacturing method is not limited to this aspect, and the other materials and the other manufacturing methods can be used.

A volume of the head 1 is not particularly limited, however, the greater the volume is, the greater the moment of inertia around the center of gravity of the head is. As a result, even in the case where a position of hitting the ball is displaced from a sweet spot SS of the hitting face 2, a displacement of the head 1 becomes small and a directionality of the hit ball becomes stable. In view of the matter mentioned above, it is desirable to set the volume of the head 1 to equal to or more than 300 $cm^3$, more preferably equal to or more than 320 $cm^3$, and particularly preferably equal to or more than 340 $cm^3$. Further, an upper limit of the head volume has no particular limitation as far as the volume is within a range which can be practically allowed as the golf club. In order to prevent the head weight from being excessively increased and prevent a durability from being reduced, it is desirable to set the head volume to equal to or less than 600 $cm^3$, for example, in a combination with any of the lower limit values, further equal to or less than 550 $cm^3$, or equal to or less than 500 $cm^3$, or equal to or less than 450 $cm^3$, or further equal to or less than 425 $cm^3$. In this case, the head volume corresponds to a volume including the neck portion 7.

Figure 2:
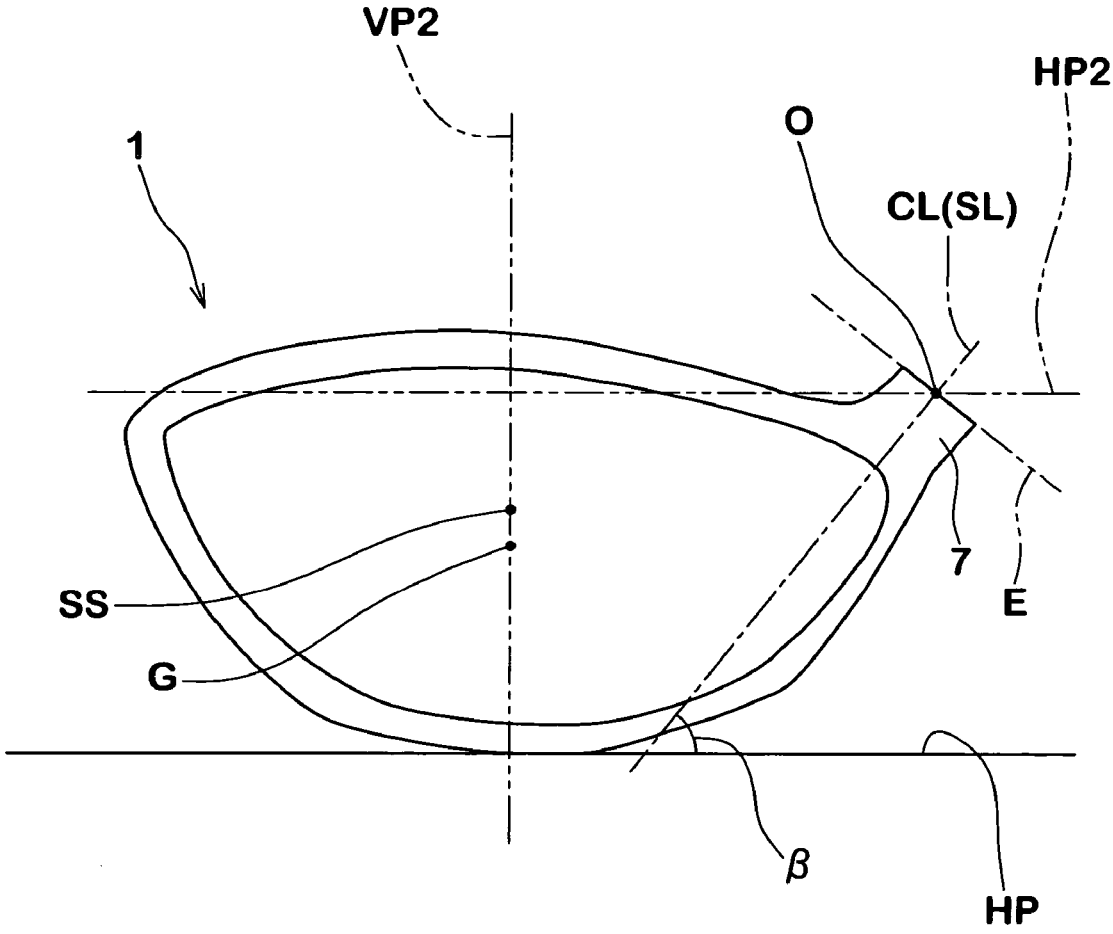
FIG. 2 is a front view showing a measured state of the head.
Figure 3:
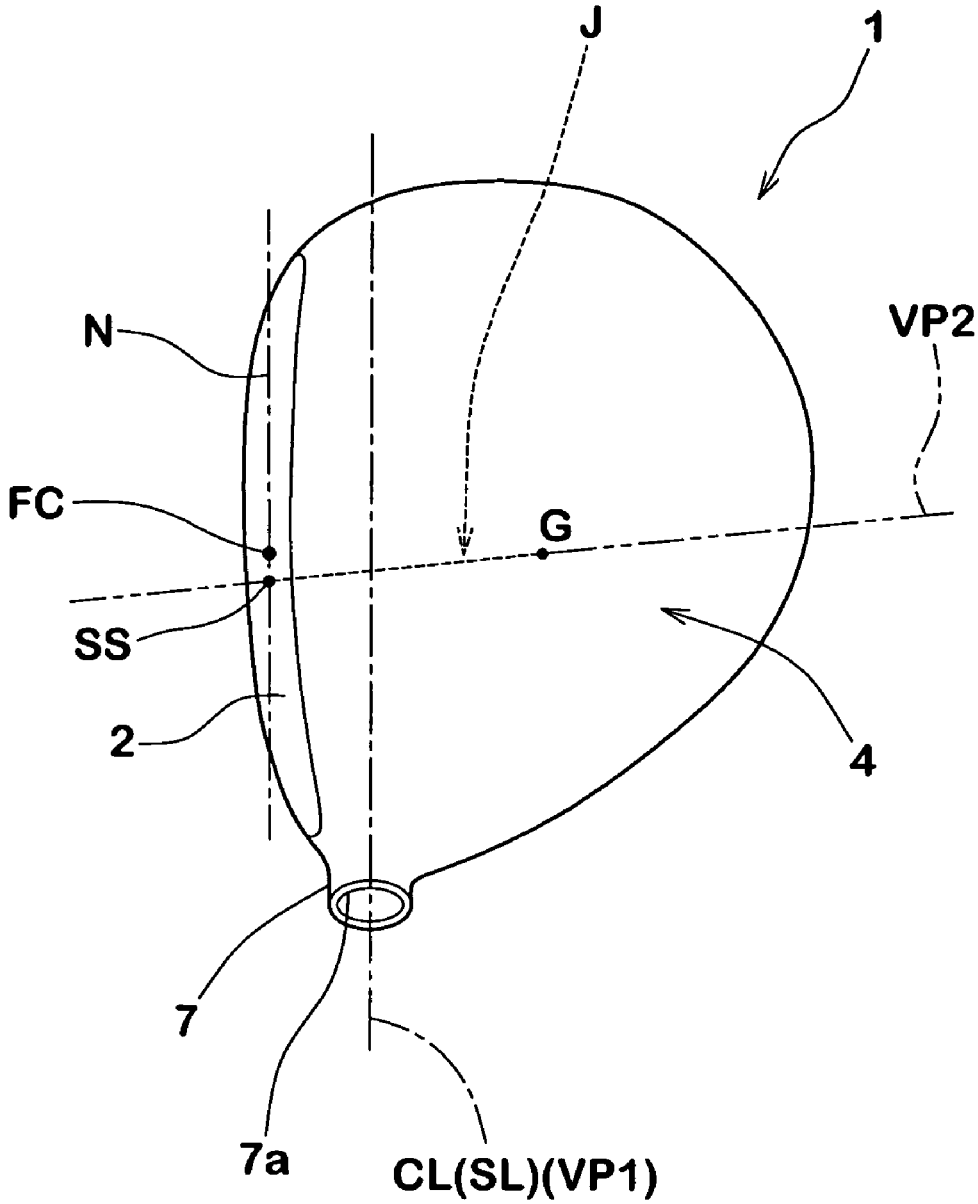
FIG. 3 is a plan view of FIG. 2.

FIG. 2 is a front view in a state where the head 1 is under a measuring state, and FIG. 3 is a plan view of FIG. 2, respectively. The "measuring state of the head 1" is such that the head 1 is placed on a horizontal plane HP, so that the axial center line SL of the shaft inclines at a defined lie angle $\beta$ within a vertical plane VP1, and the face angle of the hitting face 2 inclines at zero. Here, the face angle is the angle between the vertical plane VP1 and a horizontal tangential line N to a center of gravity FC of area of the hitting face 2.

The head 1 in accordance with the present invention satisfies the following three conditions in the moment M of inertia around the center line of the shaft axis ($g\cdot cm^3$) and the depth L of center of gravity (mm):

$$4000 \leqq M \leqq 7000; \quad (1)$$

$$30 \leqq L \leqq 50; \text{ and} \quad (2)$$

$$M \leqq 200 \times L - 2000. \quad (3)$$

The head 1 has the moment M of inertia around the center line of the shaft axis between 4000 and 7000 ($g\cdot cm^2$), as shown by the condition (1). In the case of employing the conventional general head shape, the head having the moment M of inertia of less than 4000 ($g\cdot cm^2$) has a volume of about 250 ($cm^3$) at the most. In the head, under the measured state, the moment of inertia around the vertical axis passing through the center of gravity of the head becomes small, and the directionality of the hit ball tends to be deteriorated. It is particularly desirable that the moment M of inertia of the head 1 is equal to or more than 4420 ($g\cdot cm^2$), more preferably is equal to or more than 4500 ($g\cdot cm^2$), and particularly preferably is equal to or more than 4600 ($g\cdot cm^2$).

On the other hand, in the head having the moment M of inertia larger than 7000 ($g\cdot cm^2$), it is hard to position the hitting face 2 in the address state during the swing process, and the head frequently hit the ball in a state where the hitting face 2 is opened. As a result, the slice tends to be occurred in the hit ball. In view of the matter mentioned above, it is desirable that the moment M of inertia of the head 1 is equal to or less than 6500 ($g\cdot cm^2$) in a combination of any of the lower limit values, more preferably is equal to or less than 6000 ($g\cdot cm^2$), and particularly preferably is equal to or less than 5510 ($g\cdot cm^2$).

Figure 4:
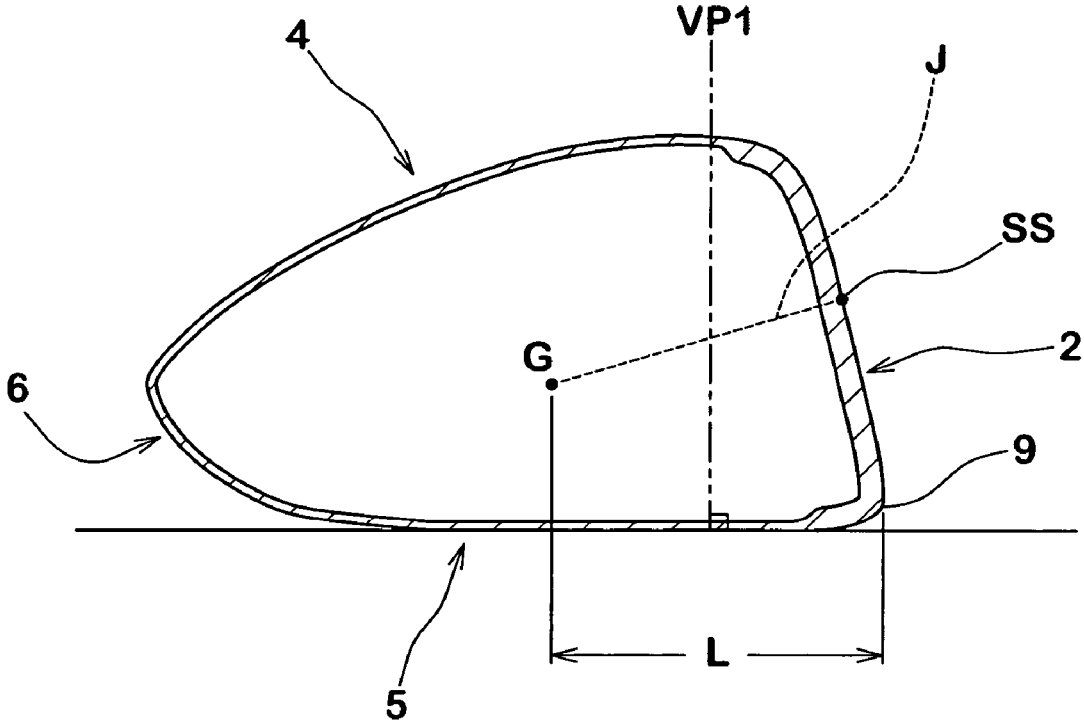
FIG. 4 is an end view in a vertical plane VP2 in FIG. 2
Figure 5:
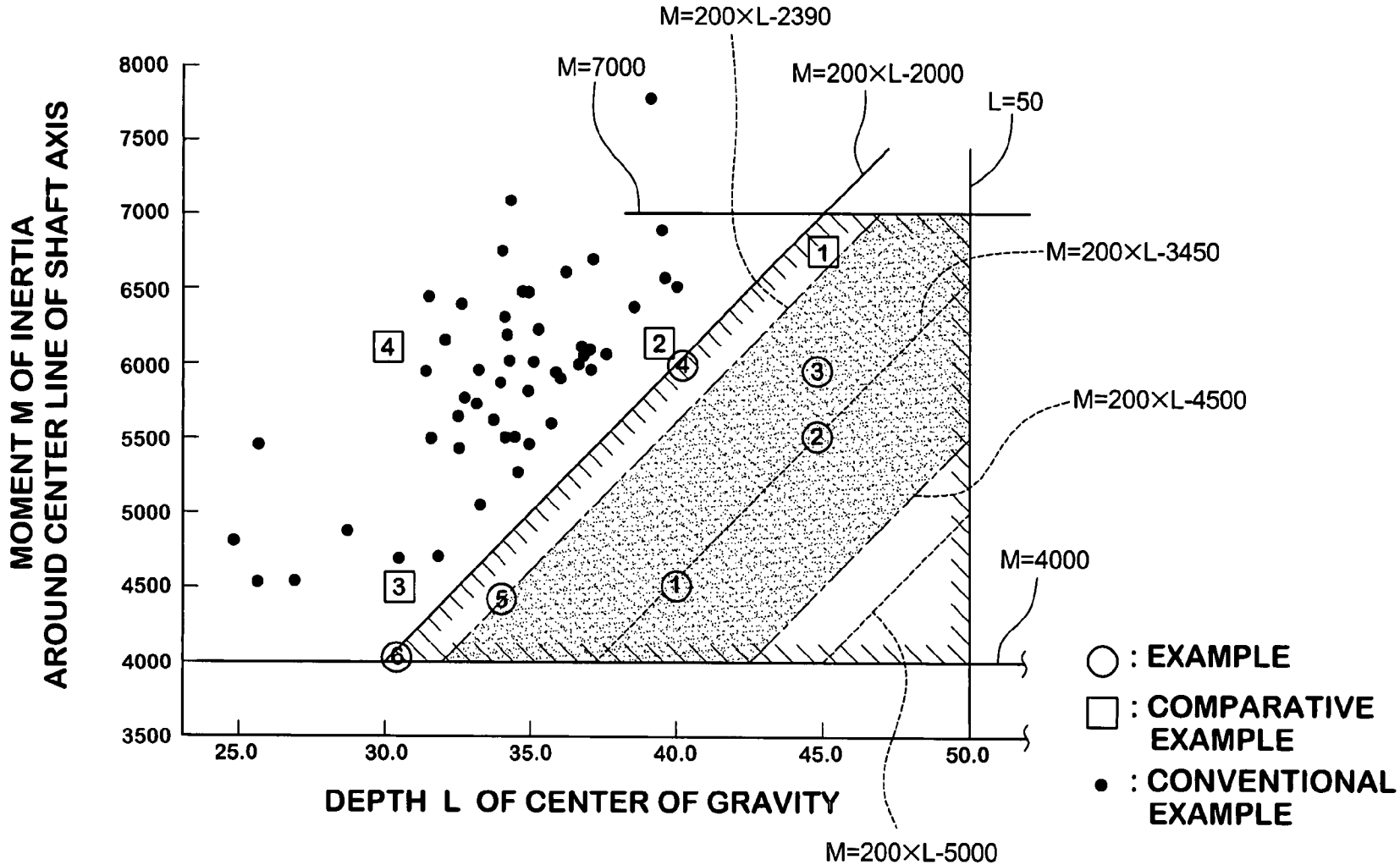
FIG. 5 is a graph showing a relation between a moment M of inertia around a center line of a shaft axis and a depth L of center of gravity.

Further, the head 1 in accordance with the present invention has the depth L of center of gravity between 30 and 50 mm, as shown by the condition (2). The depth L of center of gravity is measured as follows. As shown in FIGS. 2 and 3, in the head 1 under the measured state, a normal line J is drawn from the center of gravity G of the head to the hitting face 2. An intersecting point between the normal line J and the hitting face 2 is called as a sweet spot SS. Next, a cross sectional shape of the head is specified by a vertical plane VP2 including the normal line J. The cross sectional shape is shown in FIG. 4. Further, in the cross sectional shape, a horizontal distance between the center of gravity G of the head and a leading edge (a headmost position) 9 of the head 1 is the depth L of center of gravity.

The head 1 having t he depth L of center of gravity of less than 30 mm is displaced widely at a time of miss shot, and the directionality of the hit ball tends to be deteriorated. It is particularly desirable that the depth of center of gravity of the head 1 is preferably equal to or more than 34 mm, more preferably is equal to or more than 37 mm, and particularly preferably is equal to or more than 40 mm. On the contrary, the head 1 having the depth L of center of gravity exceeding 50 mm excessively increases the volume and makes the weight in the side of the face portion 3 small, thereby tending to deteriorate the durability and the strength balance. In view of this, it is desirable that the depth of center of gravity of the head 1 is equal to or less than 45 mm in a combination with any of the lower limit values, and more preferably is equal to or less than 42 mm.

Further, in the present invention, as shown by the condition (3), the moment M of inertia around the center line of the shaft axis and the depth L of center of gravity satisfy the fixed relational expression. The condition (3) is obtained by various experimental results by the present inventors. In other words, the head having the great moment M of inertia around the center line of the shaft axis conventionally has as such great depth L of center of gravity. Accordingly, in particular, no attention has been paid to an attempt of improving the depth L of center of gravity. The present inventors have paid attention to the attempt of improving the depth L of center of gravity of the head, and have performed a number of hitting tests. As a result, the present inventors have found that in the case of making the depth L of center of gravity significantly greater than the moment M of inertia around the center line of the shaft axis, the deterioration in the directionality of the hit ball is suppressed contrary to expectation even at a time of the miss shot (at a time of hitting by the position far away from the sweet spot SS of the hitting face 2). Further, the condition (3) is obtained by a regression analysis of the hitting test results on the assumption of two conditions (1) and (2).

A particularly preferable range in the relation between the moment M of inertia and the depth L of center of gravity is as follows:

$$M \leqq 200 \times L - 2050.$$

More preferably, the preferable range is as follows:

$$M \leqq 200 \times L - 2390.$$

The most preferable range is as follows:

$$M \leqq 200 \times L - 3450.$$

In accordance with constraint on manufacturing the head, in the combination with any of the expressions restricting the upper limit value, the lower limit value is preferably as follows:

$$M \geqq 200 \times L - 5000.$$

More preferably, the lower limit value is as follows:

$$M \geqq 200 \times L - 4500.$$

Figure 6A:
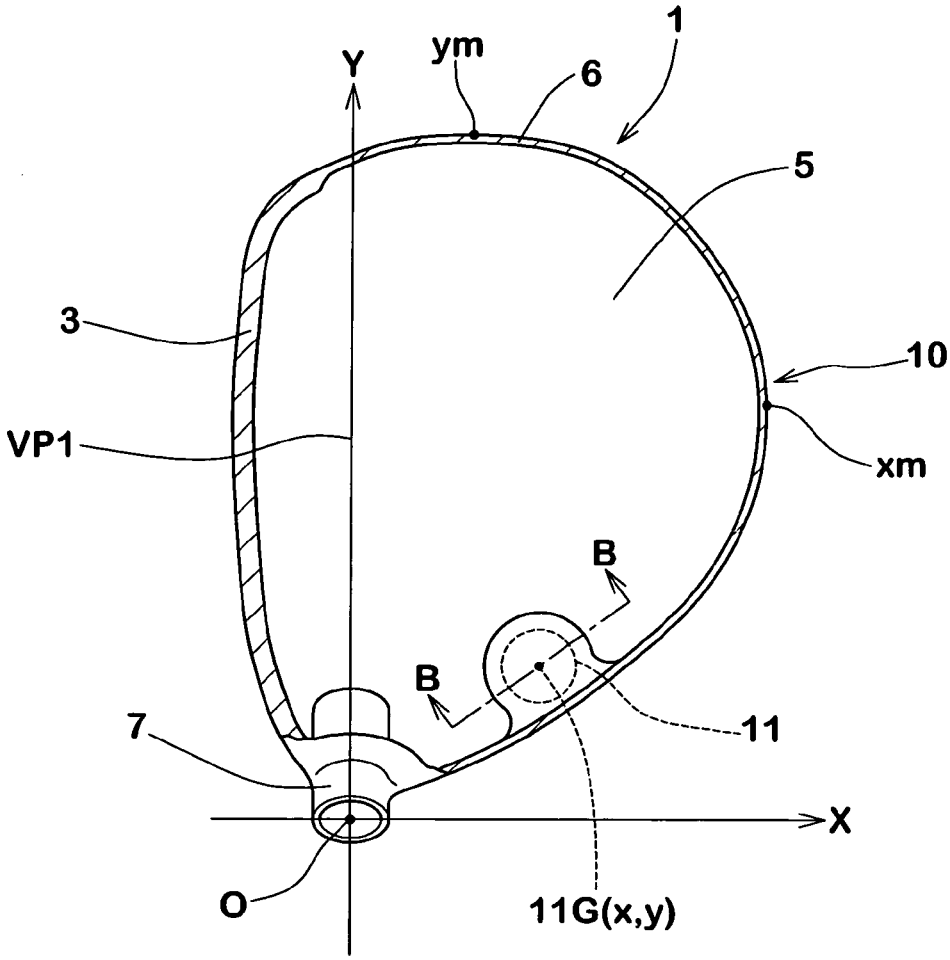
FIG. 6A is a cross sectional view of a head of an embodiment in accordance with the present invention.
Figure 6B:
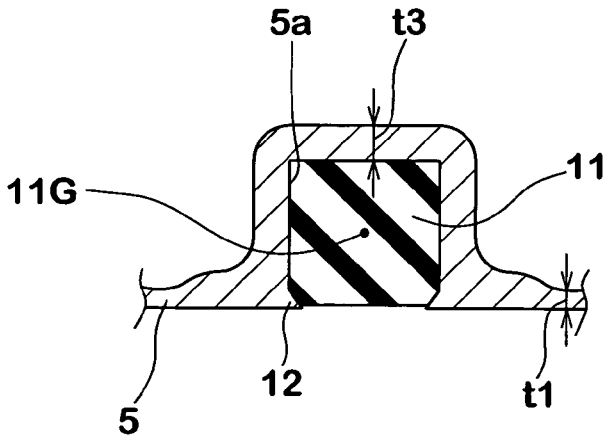
FIG. 6B is a cross sectional view taken along line B—B in FIG. 6A.

In order to manufacture the head satisfying the conditions (1), (2) and (3), it is effective to improve a weight distribution of the head 1 while increasing the volume of the head. One method is to firmly fix a weight member 11 having a high specific gravity to the heel side and the back face 10 side of the sole portion 5, as shown in FIG. 6A and FIG. 6B corresponding to the cross sectional view taken along line B—B in FIG. 6A. In this embodiment, the volume of the head is 350 $cm^3$.

The weight member 11 has a predetermined volume, and is formed in an approximately columnar shape in this embodiment. The weight member 11 can be mounted, for example, by previously forming the concave portion 5*a* having a bottom in the sole portion 5, inserting the weight member 11 thereto, and thereafter plastically deforming and caulking the concave portion 5*a* or the weight member 11 itself. An example of another mounting method includes a method of forming screw grooves on a periphery of the weight member 11 and an inner peripheral surface of the concave portion 5*a* and screwing them. Further, the weight member can be mounted by various methods such as a pressure inserting method, a welding method, a screwing method, a bonding method and the like. Only one weight member 11 is shown in the present embodiment, however, the weight member 11 can be separated into two or more pieces so as to be mounted. A thickness t3 of the concave portion 5*a* to which the weight member 11 is mounted is large, between 1.5 and 2.6 mm, however, a thickness of the other portions in the sole portion 5 is small, between 0.7 and 1.4 mm.

It is preferable that the weight member 11 is formed by a metal material, for example, having a specific gravity of 6.0 to 25.0, more preferably a specific gravity of 10.0 to 22.5, which is not particularly limited. In the case where the specific gravity is less than 6.0, a large volume is required for obtaining a great weight. This tends to a problem that a mounting property is hard and a center of gravity height is ascended. On the contrary, in the case where the specific gravity of the weight member 11 exceeds 25.0, an increase of a material cost tends to be occurred. It is preferable that the weight member 11 is made of a heavy metal, for example, Cu, Mo, Ag, Pb, Ta, W, Au, Pt, Ir or the like, and further formed by alloy including at least one of these heavy metals. In the present embodiment, there is shown the structure employing W-Cu alloy. Further, it is preferable that a mass of the weight member 11 is set to 5 to 15% of the entire mass of the head.

A position where the weight member 11 is arranged is set in such a manner as to satisfy the conditions (1), (2) and (3) in the moment M of inertia and the depth L of center of gravity. For example, a preferable range can be specified in an X-Y coordinate system shown in FIG. 6. On the assumption that a point at which the center line SL of the shaft axis crosses a virtual plane E passing through an end surface of the neck portion 7 is set to an origin O in a measured state of the head 1, the X-Y coordinate system is set on a horizontal plane HP2 passing through the origin O, as shown in FIG. 2. The Y -axis is a nodal line between the horizontal plane HP2 and the vertical plane VP1, and the X-axis is an axis line passing through the origin O and being perpendicular to the Y-axis. In a profile line of the head 1 projected on the X-Y coordinate system, the maximum value in the Y-axis is set to ym, and the maximum value in the X-axis is set to xm. A preferable position of the center of gravity 11G of the weight member 11 is set to 0.2 to 0.7 times of xm, more preferably 0.3 to 0.6 times thereof in the X-coordinate, and set to 0.1 to 0.5 times of ym, more preferably 0.1 to 0.3 times thereof in the Y-coordinate.

Figure 7A:
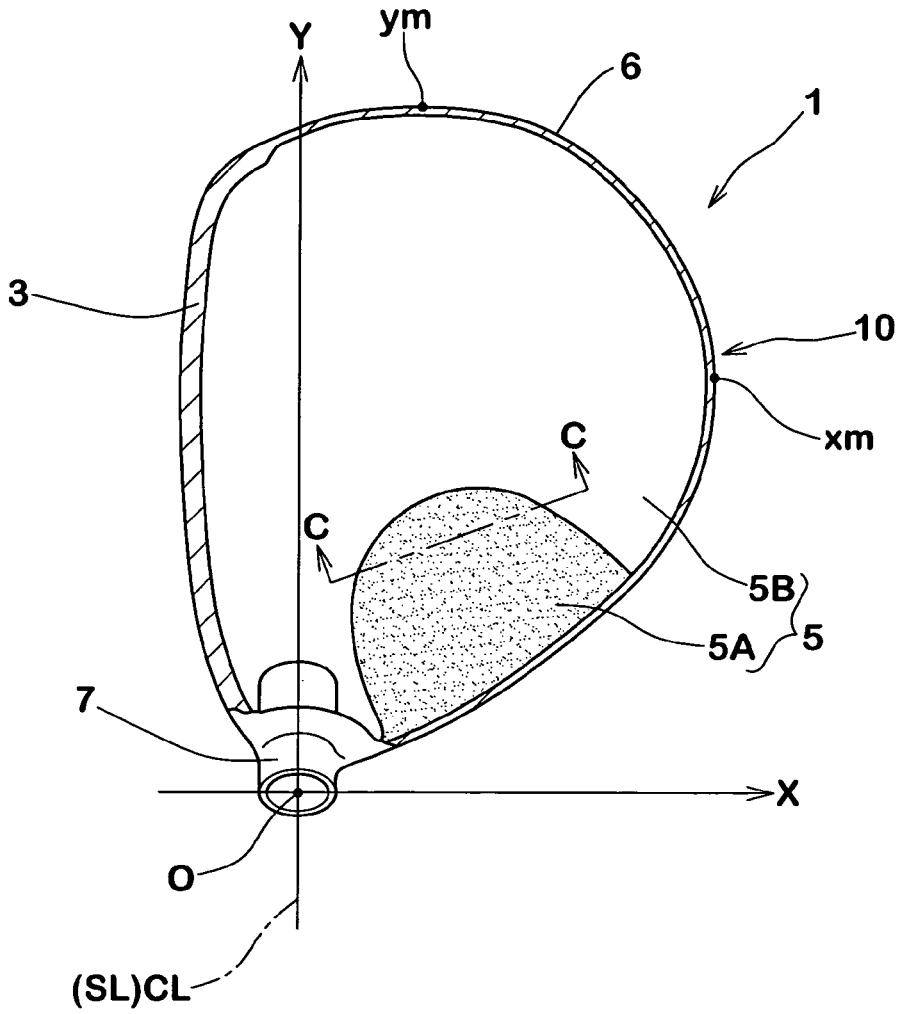
FIG. 7A is a cross sectional view of a head of another embodiment in accordance with the present invention.
Figure 7B:
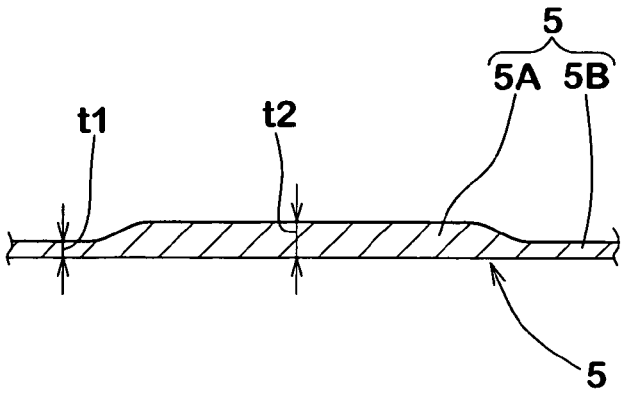
FIG. 7B is a cross sectional view taken along line C—C in FIG. 7A.

Further, in order to manufacture the head which satisfies the conditions (1), (2) and (3), as shown in FIG. 7A and FIG. 7B showing the cross section taken along line C—C, the sole portion 5 can be structured such as to include a thin portion 5B in which a thickness ti is, for example, between 0.7 and 1.4 mm, and a thick portion 5A in which a thickness t2 is, for example, between 1.5 and 2.6 mm. The thick portion 5A is formed in the heel side and the back face 10 side (dots are applied in FIG. 7A and 7B). Specifically, it is desirable in the X-Y coordinate system that the range of the thick portion 5A in the X-coordinate is formed between 0.2 and 0.7 times of xm, more preferably formed between 0.3 and 0.6 times thereof, and the range of the thick portion 5A in the Y-coordinate is formed between 0.1 and 0.5 times of ym, more preferably formed between 0.1 and 0.3 times thereof.

Figure 8A:
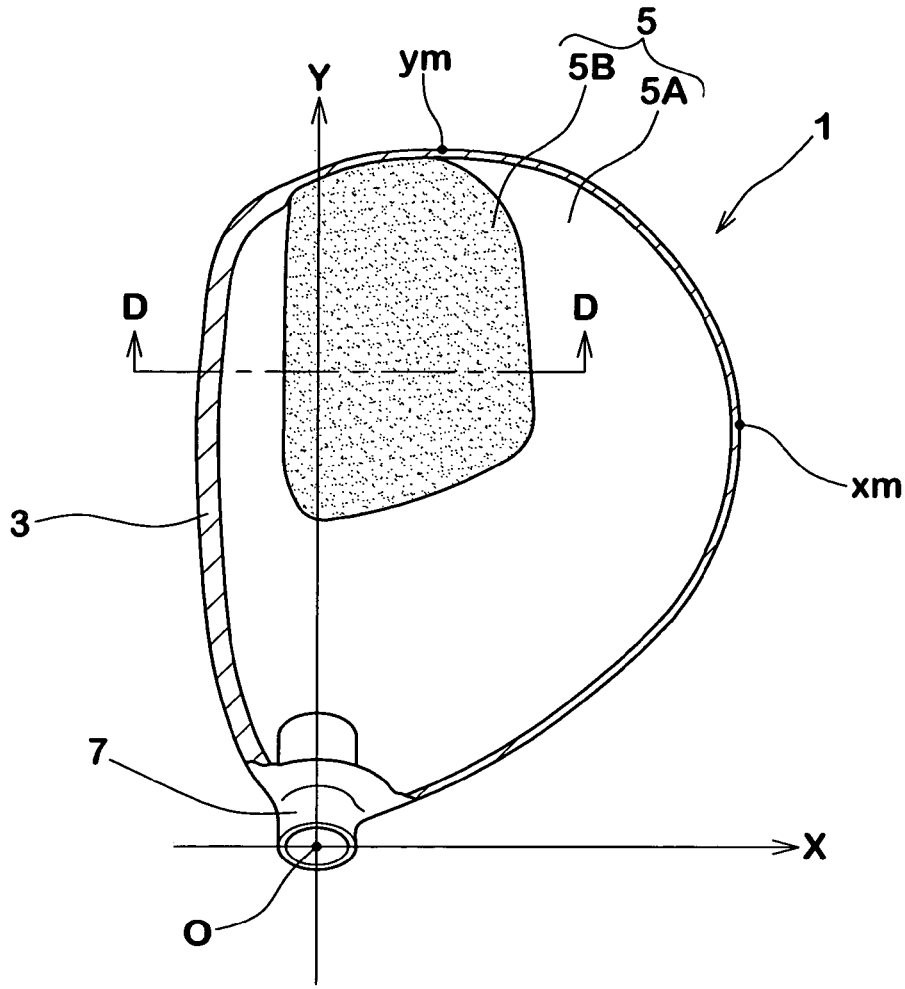
FIG. 8A is a cross sectional view of a head of still another embodiment in accordance with the present invention.
Figure 8B:
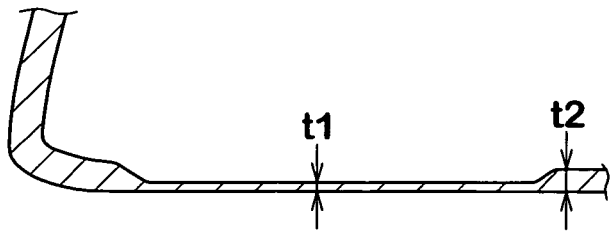
FIG. 8B is a cross sectional view taken along line D—D in FIG. 8A.

Further, in reverse to FIGS. 7A and 7B, as shown in FIG. 8A and FIG. 8B showing the cross section taken along line D—D in FIG. 8A, it is desirable that the sole portion 5 is constituted by the thin portion 5B and the thick portion 5A, and the thin portion 5B is formed in the toe side and the face portion 3 side (dots are applied in FIGS. 8A and 8B). Specifically, it is desirable in the X-Y coordinate system that the range of the X-coordinate of the thin portion 5B is formed to be equal to or less than 0.6 times of xm, more preferably equal to or less than 0.5 time thereof, and the range of the Y-coordinate of the thin portion 5B is formed to be equal to or more than 0.4 time of ym, more preferably equal to or more than 0.5 times thereof.

Figure 9A:
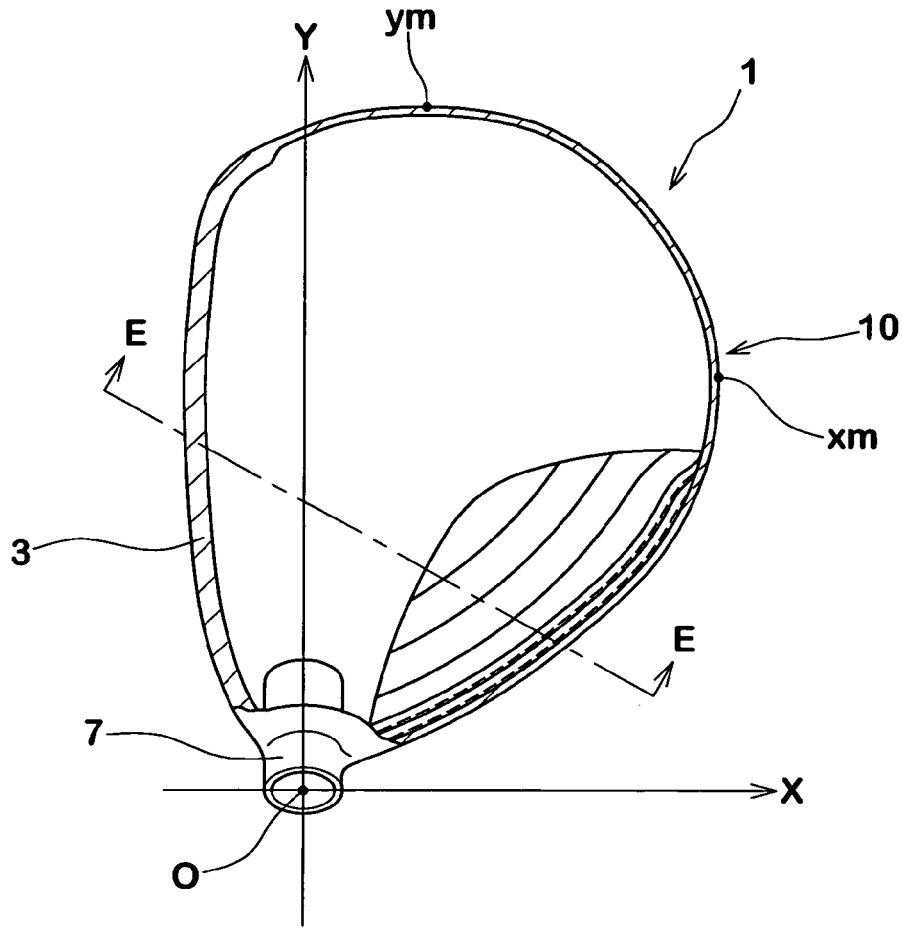
FIG. 9A is a cross sectional view of a head of yet another embodiment in accordance with the present invention.
Figure 9B:
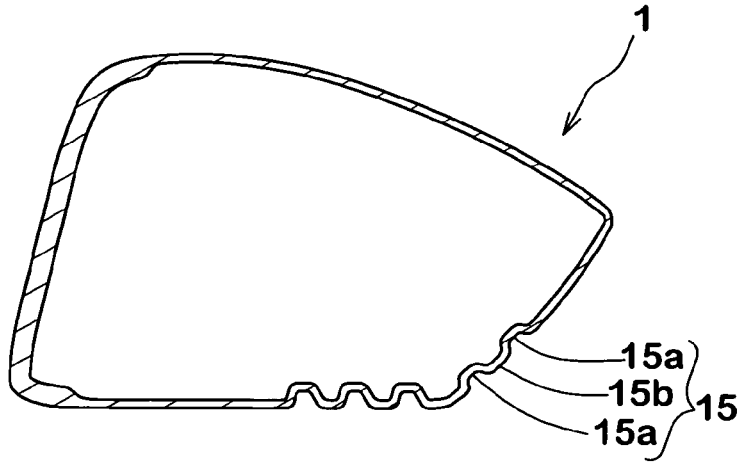
FIG. 9B is a cross sectional view taken along line E—E in FIG. 9A.

Further, in order to manufacture the head which satisfies the conditions (1), (2) and (3), as shown in FIG. 9A and FIG. 9B showing the cross section taken along E—E in FIG. 9A, the surface area may be increased in the range close to the heel and close to the back face 10. In the present embodiment, there is shown the structure in which the range is formed in a wavy portion 15 where the concave portions and the convex portions 15*b* are alternately connected. Accordingly, it is possible to increase the weight of the wavy portion 15, thereby increasing the depth L of center of gravity. Further, the range increasing the surface area is particularly set in the X-Y coordinate system such that the range of X-coordinate is equal to or more than 0.1 times of xm, more preferably equal to or more than 0.2 times thereof, and the range of Y-coordinate is equal to or less than 0.5 times of ym, more preferably equal to or less than 0.4 times thereof.

It goes without saying that the head 1 in accordance with the present invention can be applied to a fairway wood or the like in addition to the driver. It is desirable that the head is applied to a head having a loft angle between about 7 and 12°, more preferably to a head having a loft angle between 10.5 and 12° mainly applied to an average golfer, chiefly to a head having a loft angle between about 11 and 12°.

As described above, the gold club head in accordance with the present invention can improve the directionality of the hit ball by suitably limiting the moment M of inertia around the center line of the shaft axis and the depth L of center of gravity.

EXAMPLES

A wood type golf club head having the base aspect shown in FIG. 1 was manufactured by way of trial on the basis of the specification in Table 1. The wood type golf club of an entire length 45 inch and a balance DO was manufactured by attaching the same carbon shaft (MP-200 FLEX R manufactured by SUMITOMO RUBBER INDUSTRY Co., Ltd.) to each of the heads, and a hitting test was performed. Each of the heads was formed by lost wax precision casting Ti-6Al-4V, and was unified as a loft angle of 11°, a face angle of 2°, a lie angle of 56°, a head mass of 188 g, and head volume of 350 $cm^3$. Both of a face bulge and a face roll were unified as 254 mm. Further, the center of gravity of the head was adjusted in accordance with a method of mounting the weight member (W-Cu alloy) to the sole portion, as shown in FIG. 6.

The hitting test was performed by ten right-handed golfers who were not too skilled and have a handicap of twenty or more each hitting ten golf balls ("MAXFLI HI-BRID" manufactured by SUMITOMO RUBBER INDUSTRY Co., Ltd.). In this case, an amount of lateral displacement between a point of fall of the hit ball and a line in a target direction was measured. As evaluation, an average value in the displacement amount and an average value of an absolute value in the displacement amount were determined. The average value in the displacement amount was determined by adding each of the displacement amounts and dividing by the ball number ten, on the assumption that the hit ball displaced in a left direction with respect to the target direction line was set to a minus value and the hit ball displaced in a right direction was set to a plus value. The average value of the absolute value in the displacement amount was determined by adding the absolute value of each of the displacement amounts and dividing by the ball number ten. In both cases, the results of ten golfers were further averaged. The "average value in the displacement amount" is useful for mainly judging the directionality in right and left directions. In other words, it is known that the ball tends to fly rightward in the case of plus value, and the ball tends to fly leftward in the case of minus value. Further, in the "average value of the absolute value in the displacement amount", it is known that the greater the value is, the greater the dispersion is.

In this case, the moment of inertia of the head is measured by using MOMENT OF INERTIA MEASURING INSTRUMENT manufactured by INERTIA DYNAMICS Inc Co., Ltd. Results of test and the like are shown in Table 1.

TABLE 1

| | | Example 1 | Example 2 | Example 3 | Example 4 | Example 5 |
|---|---|---|---|---|---|---|
| Moment M of inertia around center line of shaft axis [g · $cm^2$] | | 4508 | 5510 | 5950 | 5990 | 4420 |
| Depth L of center of gravity [mm] | | 40.0 | 44.8 | 44.8 | 40.2 | 34.0 |
| Value obtained by 200L − M [value equal to or more than 2000 satisfies expression (3)] | | 3492 | 3450 | 3010 | 2050 | 2380 |
| Mass of weight member [g] | | 35 | 38 | 27 | 25 | 37 |
| Arrangement position (x, y) of weight member [mm] * | | (25, 21) | (58, 29) | (65, 54) | (49, 60) | (23, 38) |
| Thickness of sole portion in the vicinity of arrangement position of weight member [mm] | | 2.4 | 2.3 | 1.5 | 1.5 | 2.5 |
| Thickness of sole portion in the other position than the above position [mm] | | 1.1 | 1.1 | 1.3 | 1.3 | 1.1 |
| Results of test | Average in displacement amount (m) | −4.0 | +2.8 | +4.9 | +5.3 | −5.1 |
| | Average of absolute value in displacement amount (m) | 9.6 | 9.3 | 11.2 | 16.3 | 13.3 |

TABLE 1-continued

| | | Example 6 | Comparative Example 1 | Comparative Example 2 | Comparative Example 3 | Comparative Example 4 |
|---|---|---|---|---|---|---|
| Moment M of inertia around center line of shaft axis [g · cm$^2$] | | 4030 | 6850 | 6138 | 4500 | 6110 |
| Depth L of center of gravity [mm] | | 30.4 | 44.0 | 39.4 | 30.0 | 30.1 |
| Value obtained by 200L − M [value equal to or more than 2000 satisfies expression (3)] | | 2050 | 1950 | 1742 | 1500 | −90 |
| Mass of weight member [g] | | 39 | 25 | 27 | 33 | 27 |
| Arrangement position (x, y) of weight member [mm] * | | (15, 21) | (65, 63) | (45, 83) | (0, 37) | (0, 90) |
| Thickness of sole portion in the vicinity of arrangement position of weight member [mm] | | 2.7 | 1.5 | 1.5 | 2.0 | 1.5 |
| Thickness of sole portion in the other position than the above position [mm] | | 1.1 | 1.3 | 1.3 | 1.2 | 1.1 |
| Results of test | Average in displacement amount (m) | −5.9 | +11.5 | +6.1 | −4.2 | +5.3 |
| | Average of absolute value in displacement amount (m) | 17.8 | 13.5 | 18.9 | 19.2 | 22.0 |

Example 1 is good because the average value in the displacement amount is small. Further, since the average value in the displacement amount is small −4.0 m and is directed in the left direction, it can be confirmed that the slice is effectively prevented. Example 2 has the smaller average value of the absolute value in the displacement amount and is good because the depth of center of gravity and the moment of inertia are greater than those of Example 1. However, in comparison with Example 1, the direction of the hit ball is directed slightly in the right direction. This can be considered because the moment M of inertia is great. Example 3 corresponds to the head obtained by making only the moment M of inertia large in Example 2. In comparison with Example 2, the dispersion of the hit ball is slightly great, and the displacement amount in the right direction is slightly increased in the directionality.

In Example 4, the depth of center of gravity is set to be approximately the same as that of Example 1, however, the moment M of inertia is the largest. Accordingly, in comparison with Example 1, the dispersion of the hit ball and the displacement amount in the right direction are increased. In Example 5, the moment M of inertia is approximately the same as that of Example 1, and only the depth of center of gravity is made small in comparison with Example 1. In accordance with the results of hitting, in comparison with Example 1, the slice of the hit ball is restricted, and the dispersion is sufficiently within an allowable range. Example 6 corresponds to the head in which the depth of center of gravity and the moment M of inertia are the smallest. Accordingly, it can be confirmed that the effect of preventing the slice is very high while the dispersion is slightly distinctive.

In Comparative Example 1, since the moment M of inertia is too large, it is known that the dispersion is great and the displacement in the right direction is great. Since Comparative Examples 2 to 4 do not satisfy the condition (3), the dispersion is further great.

What is claimed is:

1. A wood-type golf club head, which comprises:

a face portion forming a hitting face hitting a ball;

a crown portion extending from an upper edge of the hitting face and forming an upper surface of the head;

a sole portion extending from a lower edge of the hitting face and forming a bottom surface of the head;

a side portion extending between the crown portion and the sole portion from a toe side edge of the hitting face to a heel side edge of the hitting face through a back face; and a neck portion formed with a shaft insertion hole to which one end of a shaft is attached, wherein in a measuring state where an axial center line of the shaft insertion hole is arranged in a vertical plane and is inclined at a lie angle β determined in accordance with the head, and a face angle is set to zero, a point at which the axial center line of the shaft insertion hole crosses a virtual plane passing through an upper end surface of the neck portion is set to an origin O, and a two-dimensional X-Y coordinate in which a Y-axis is a nodal line between the horizontal plane and the vertical plane, and an X-axis is an axis line passing through the origin O and being perpendicular to the Y-axis is virtually set on the horizontal plane passing through the origin O, and in the case where the maximum value of the Y-axis in a profile line of the head projected on the X-Y coordinate system is set to ym and the maximum value of the X-axis is set to xm, a weight member having a great specific gravity is firmly attached to the sole portion in an area where a center of gravity of the weight member is set to 0.2 to 0.7 times of the xm value in the X-coordinate and set to 0.1 to 0.5 times of the ym value in the Y-coordinate, wherein the specific gravity is in the range of from 6.0 to 25.0, the weight member is mounted in a concave portion formed on the sole portion, and the golf club head satisfies the following three conditions in a moment M of inertia around a center line of a shaft axis ($g \cdot cm^2$) and a depth L of center of gravity (mm):

$$5950 \leqq M \leqq 7000; \quad (1)$$

$$30 \leqq L \leqq 50; \text{ and} \quad (2)$$

$$M \leqq (200 \times L) - 2000. \quad (3)$$

2. The golf club head according to claim 1, further satisfying the following two conditions:

$$M \leqq 200 \times L - 2390; \text{ and} \quad (4)$$

$$M \geqq 200 \times L - 4500. \quad (5)$$

3. The golf club head according to claim 1, further satisfying the following condition:

$$5950 \leqq M \leqq 6500. \quad (6)$$

4. The golf club head according to claim 1, further satisfying the following condition:

$$5950 \leqq M \leqq 6000. \quad (7)$$

5. The golf club head according to claim 1, further satisfying the following condition:

$$34 \leqq L \leqq 45. \quad (8)$$

6. The golf club head according to claim 1, further satisfying the following condition:

$$37 \leqq L \leqq 42. \quad (9)$$

7. The golf club head according to claim 1, further satisfying the following two conditions:

$$M \leqq 200 \times L - 2050; \text{ and} \quad (10)$$

$$M \geqq 200 \times L - 5000. \quad (11)$$

8. The golf club head according to claim 1, further satisfying the following two conditions:

$$M \leqq 200 \times L - 3450; \text{ and} \quad (12)$$

$$M \geqq 200 \times L - 4500. \quad (13)$$

9. The golf club head according to claim 1, wherein the concave portion has a thickness larger than other portions in the sole portion.

10. The golf club head according to claim 1, wherein the concave portion has a bottom in contact with the weight member.

11. The golf club head according to claim 1, wherein the weight member is mounted in the concave portion by plastically deforming the concave portion or the weight member itself.

12. The golf club head according to claim 1, wherein the weight member has a mass of 5% to 15% of the entire mass of the head.

13. The wood-type golf club head according to claim 1, further satisfying the following condition:

$$5990 \leqq M \leqq 7000; \quad (14)$$

14. A wood-type golf club head, which comprises:

a face portion forming a hitting face hitting the ball;

a sole portion extending from a lower edge of the hitting face and forming a bottom surface of the head, said sole portion having a concave portion for inserting a weight member thereto; and the weight member mounted in the concave portion having a specific gravity in the range from 6.0 to 25.0, said weight member comprising:

a columnar body; and a tapered portion extending from the columnar body to the outer surface of the sole portion, said tapered portion being covered with a plastically deforming portion of the concave portion so that the columnar body is fixed in the concave portion, wherein the golf club head satisfies the following three conditions in a moment M of inertia around a center line of a shaft axis ($g \cdot cm^2$) and a depth L of center of gravity (mm):

$$5990 \leqq M \leqq 7000; \quad (1)$$

$$30 \leqq L \leqq 50; \text{ and} \quad (2)$$

$$M \leqq (200 \times L) - 2000. \quad (3)$$

* * * * *